US010916828B2

(12) United States Patent
Maley et al.

(10) Patent No.: US 10,916,828 B2
(45) Date of Patent: Feb. 9, 2021

(54) RADIO ANTENNA ELEMENT ARM RETAINING CLIP

(71) Applicant: CommScope Technologies LLC, Hickory, NC (US)

(72) Inventors: Gregory J. Maley, Downers Giove, IL (US); Peter J. Bisiules, Lagrange, IL (US)

(73) Assignee: CommScope Technologies LLC, Hickory, NC (US)

( * ) Notice: Subject to any disclaimer, the term of this patent is extended or adjusted under 35 U.S.C. 154(b) by 512 days.

(21) Appl. No.: 15/534,811

(22) PCT Filed: Jan. 8, 2016

(86) PCT No.: PCT/US2016/012646
§ 371 (c)(1),
(2) Date: Jun. 9, 2017

(87) PCT Pub. No.: WO2016/114990
PCT Pub. Date: Jul. 21, 2016

(65) Prior Publication Data

US 2017/0373370 A1 Dec. 28, 2017

Related U.S. Application Data

(60) Provisional application No. 62/103,289, filed on Jan. 14, 2015.

(51) Int. Cl.
*H01Q 1/12* (2006.01)
*H01Q 1/20* (2006.01)
(Continued)

(52) U.S. Cl.
CPC ..... *H01Q 1/1207* (2013.01); *H01Q 1/18* (2013.01); *H01Q 1/20* (2013.01); *H01Q 21/26* (2013.01); *H01Q 1/246* (2013.01)

(58) Field of Classification Search
CPC ..... H01Q 21/26; H01Q 21/1207; H01Q 1/18; H01Q 1/20; H01Q 1/1207; H01Q 1/12; H01Q 1/1242; H01Q 1/246
See application file for complete search history.

(56) References Cited

U.S. PATENT DOCUMENTS 5,864,318 A 1/1999 Cosenza et al.
9,923,280 B2 * 3/2018 Segador ..... H01Q 9/285
(Continued)

FOREIGN PATENT DOCUMENTS

WO WO 2014/084659 A1 6/2014

OTHER PUBLICATIONS

Notification of Transmittal of the international Search Report and the Written Opinion of the International Searching Authority, or the Declaration corresponding to International Application No. PCT/US2016/012646; dated Apr. 19, 2016.
(Continued)

*Primary Examiner* — Dameon E Levi
*Assistant Examiner* — Jennifer F Hu
(74) *Attorney, Agent, or Firm* — Myers Bigel, P.A.

(57) ABSTRACT

A clip for securing a radiating arm to a printed circuit boards of a radio frequency antenna element of a base station antenna. The radiating arm may be configured to receive signals or radiate signals from a feed network associated with the at least one RF antenna member. The radiating arm can be secured to the printed circuit board without the use of solder or adhesives.

19 Claims, 9 Drawing Sheets

(51) Int. Cl.

| | |
|---|---|
| ***H01Q 21/26*** | (2006.01) |
| ***H01Q 1/18*** | (2006.01) |
| ***H01Q 1/24*** | (2006.01) |

(56) References Cited

U.S. PATENT DOCUMENTS

| | | | | |
|---|---|---|---|---|
| 2002/0135520 | A1* | 9/2002 | Teillet | H01Q 21/26 343/700 MS |
| 2006/0232490 | A1 | 10/2006 | Bisiules et al. | |
| 2007/0229385 | A1 | 10/2007 | Deng et al. | |
| 2012/0038540 | A1* | 2/2012 | Jacob | H01Q 21/26 343/878 |
| 2013/0314292 | A1* | 11/2013 | Maley | H01Q 1/1207 343/797 |
| 2015/0263434 | A1* | 9/2015 | Bench | H01Q 21/24 342/357.51 |

OTHER PUBLICATIONS

Notification Concerning Transmittal of International Preliminary Report on Patentability corresponding to International Application No. PCT/US2016/012646; dated Jul. 27, 2017.

* cited by examiner

RADIO ANTENNA ELEMENT ARM RETAINING CLIP

This application claims the benefit of U.S. Provisional Patent Application No. 62/103,289, filed on Jan. 14, 2015, the entire contents of which are incorporated herein by reference in their entirety.

BACKGROUND

Various aspects of the present disclosure may relate to radiating elements, and, more particularly, to an apparatus for securing radio antenna element arms to radiating elements.

Antennae for wireless voice and/or data communications may typically include an array of radio antenna elements (i.e., radiating elements) connected by one or more feed networks. For quality transmission and reception of Radio Frequency (RF) signals, one or more diversity techniques may be employed. One such diversity technique is polarization diversity, which may be particularly effective in combating multi-path fading. Crossed RF antenna members (forming a radiating element) may be used to employ polarization diversity. Each of the crossed RF antenna members may include a printed circuit board (PCB) and a radiating arm extending therefrom. Solder and/or adhesives may be typically used to attach the radiating arm to a desired location along the printed circuit board. However these attachment techniques may be costly, insecure, and may affect RF performance of the radiating element and, in turn, the overall antenna.

As such, it would be advantageous to have an apparatus to connect a radiating arm to a radiating element in a more secure, cost efficient manner.

SUMMARY OF THE DISCLOSURE

Various aspects of the present disclosure may be directed to a clip for securing one or more radiating arms to at least one RF antenna member of a base station antenna. In one aspect, the clip may include a central body and a retaining assembly extending radially therefrom. The retaining assembly may be configured to be connected to at least one of the one or more radiating arms.

BRIEF DESCRIPTION OF THE SEVERAL VIEWS OF THE DRAWINGS

The following detailed description of the disclosure will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown.

In the drawings.

DETAILED DESCRIPTION OF VARIOUS EMBODIMENTS

Figure 1:
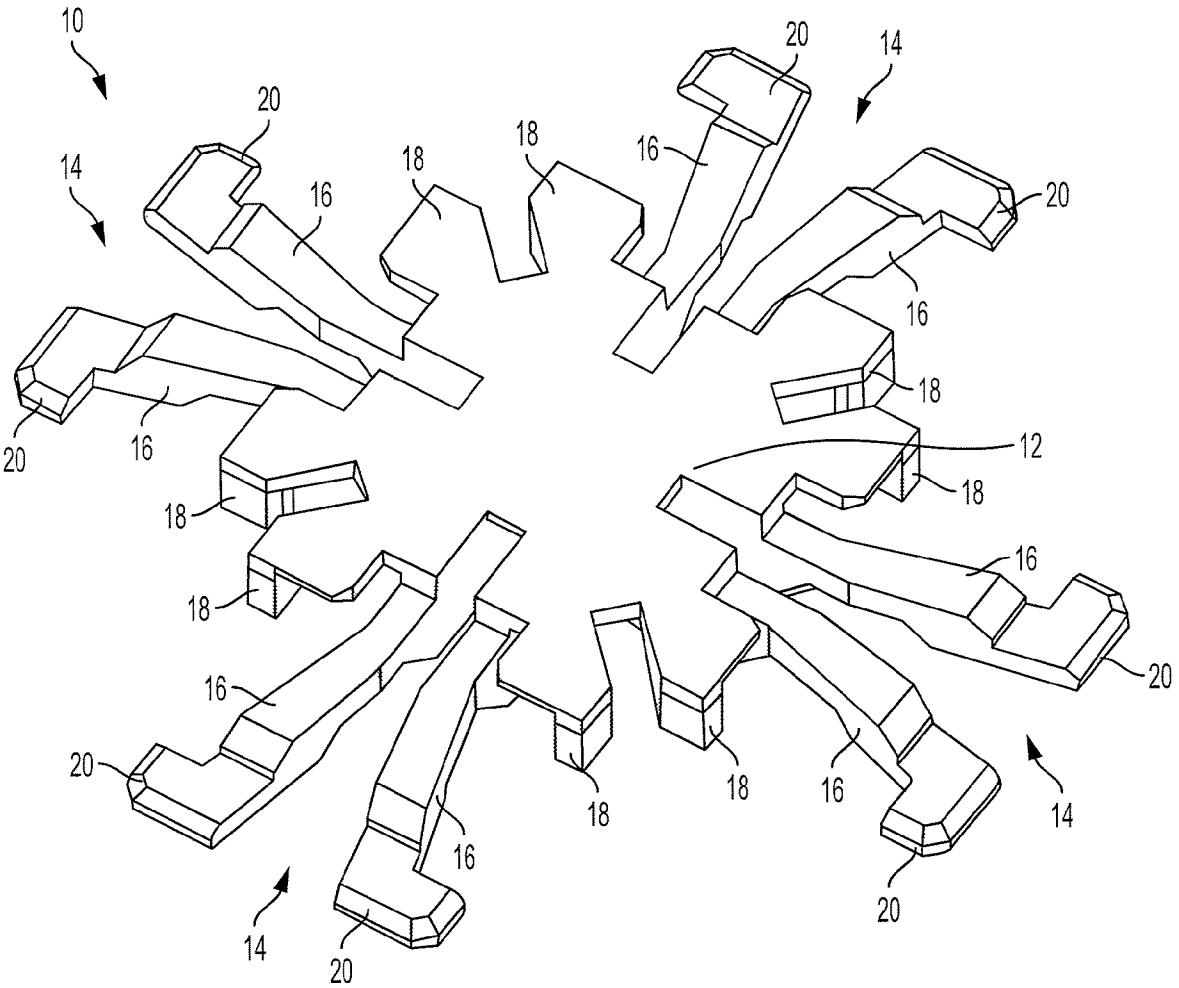
FIG. 1 is a perspective view of a retaining clip, according to an aspect of the present disclosure.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Aspects of the present disclosure may be directed to a retaining clip for securing one or more radiating arms to one or more PCBs of an antenna member of a base station antenna. Referring to FIG. 1, the retaining clip 10 may include a central body 12, and four retaining assemblies 14 extending radially from the central body 12. Each of the four retaining assemblies 14 may include two deflectable fingers 16 positioned between arm supports 18. Each of the two deflectable fingers 16 may include a tab 20 located at an end opposite the central body 12 of the retaining clip 10. The retaining clip 10 may be made from a thermoplastic, or other resilient plastic material.

Figure 2:
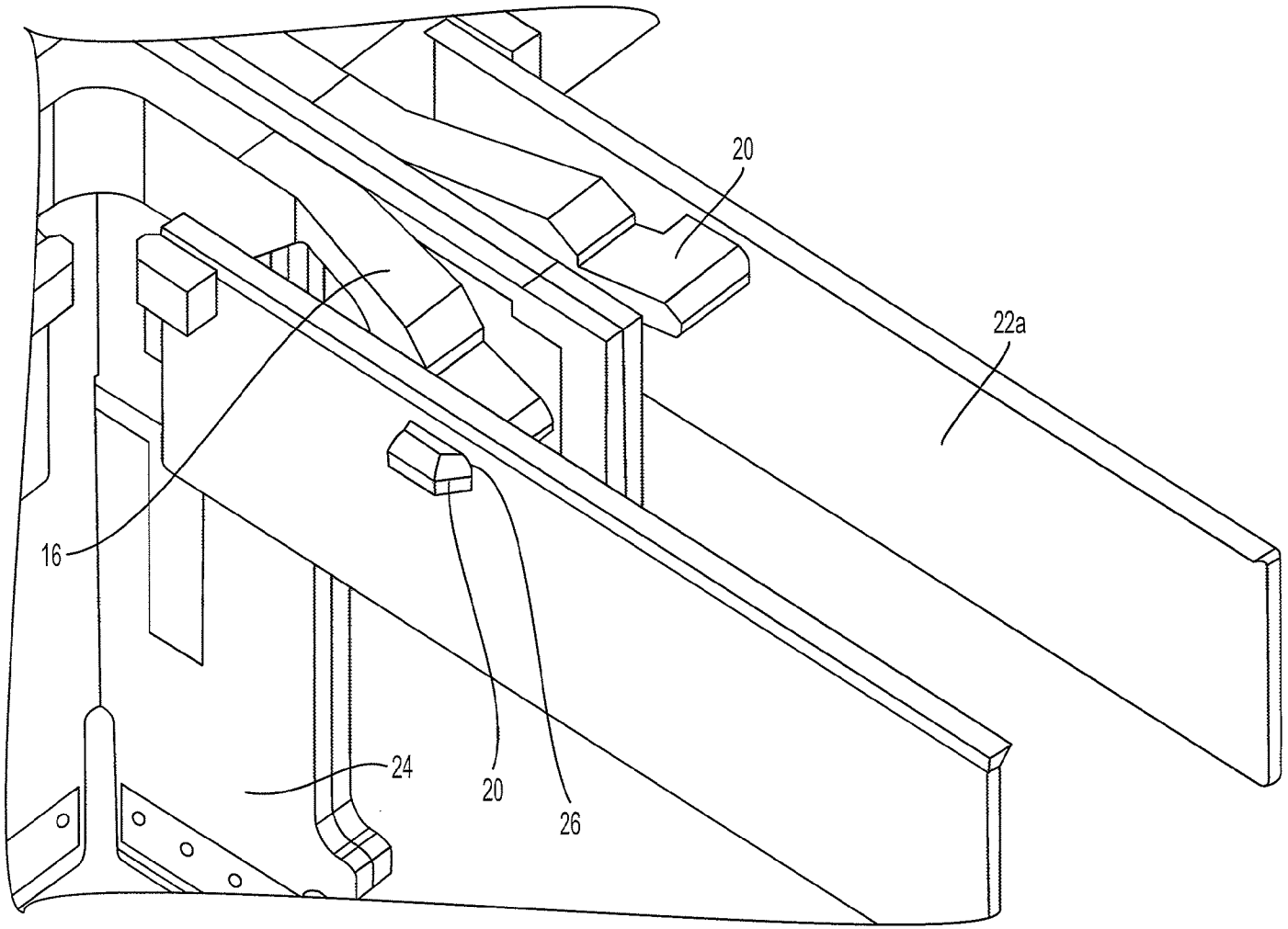
FIG. 2 is a cross-sectional view of one radiating arm, coupled to a PCB via tabs of a pair of deflectable fingers of the retaining clip, according to an aspect of the present disclosure.
Figure 3:
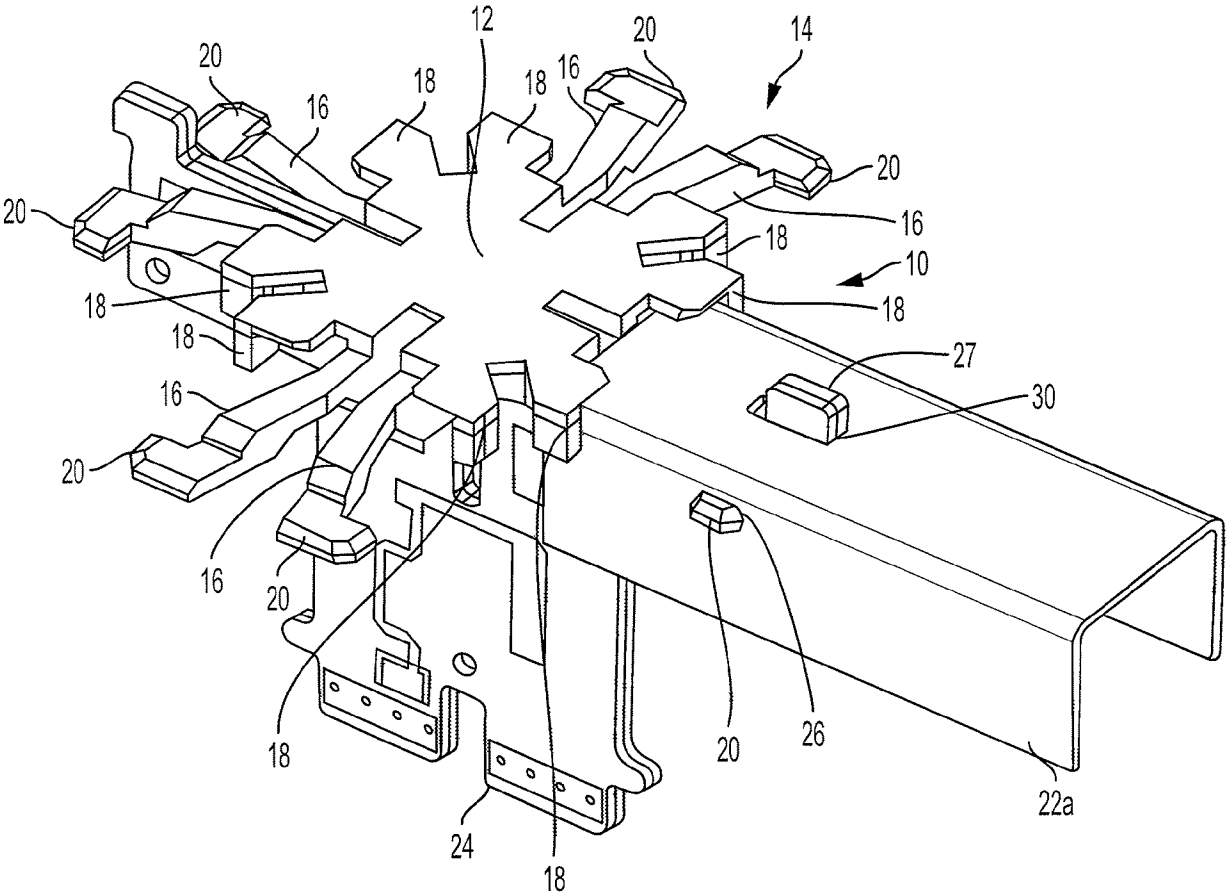
FIG. 3 is perspective a view of one radiating arm coupled to a PCB via a pair of tabs extending from deflectable fingers of the retaining clip, according to an aspect of the present disclosure.

As discussed above, an antenna member may include a PCB and a radiating arm extending therefrom. The radiating arm may serve to receive signals, or radiate signals from a feed network of a feedboard, through the PCB, to the environment. FIGS. 2 and 3 illustrate one such radiating arm 22*a* coupled to one such PCB 24 via the retaining clip 10. As best seen in FIG. 2 (a cross-sectional view of the coupling with an upper portion of the radiating arm 22 removed), respective tabs 20 of the deflectable fingers 16 of one of the retaining assemblies 14 may be secured in side voids or holes 26 located on opposing side portions of the radiating arm 22. As shown in FIG. 3, a capture 27 on the PCB 24 may be secured in a top hole 30 located on the upper portion of the radiating arm 22. For increased stability, an end of the radiating arm 22 may rest between the arm supports 18 of the retaining assembly 14.

Figure 4:
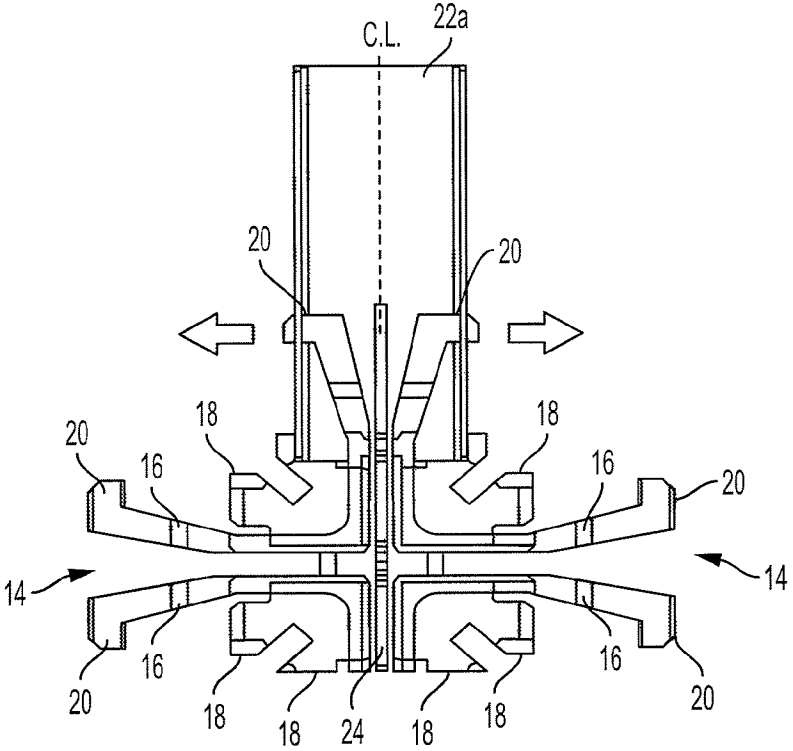
FIG. 4 is a view of an underside of the retaining clip coupling one radiating arm to a PCB of an antenna member, according to an aspect of the present disclosure.

FIG. 4 is an illustration of the underside of the retaining clip 10 connecting a radiating arm 22 to the PCB 24. The deflectable fingers 16 of the retaining clip 10 may be able to secure the radiating arm 22 to the PCB 24, at least in part, because of an outward biasing force causing the tabs 20 to be retained in side holes 26 of the radiating arm 22, thus, at least in part, locking the radiating arm 22 in a center position on the PCB 24. Such secure centering on the PCB 24 may result in optimal electrical RF performance.

Figure 5:
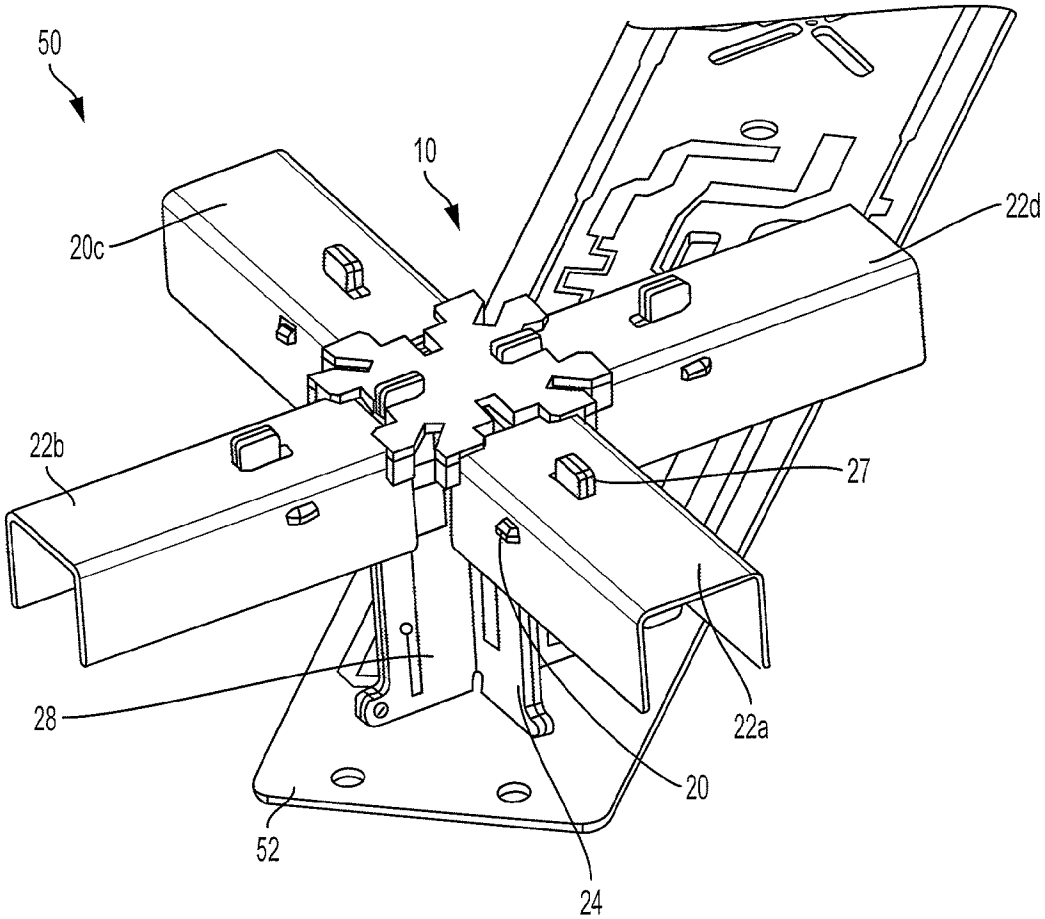
FIG. 5 is a perspective view of a full assembly of a radiating element including four radiating arms attached to two crossed PCBs of respective antenna members, via the retaining clip, according to an aspect of the present disclosure.
Figure 6:
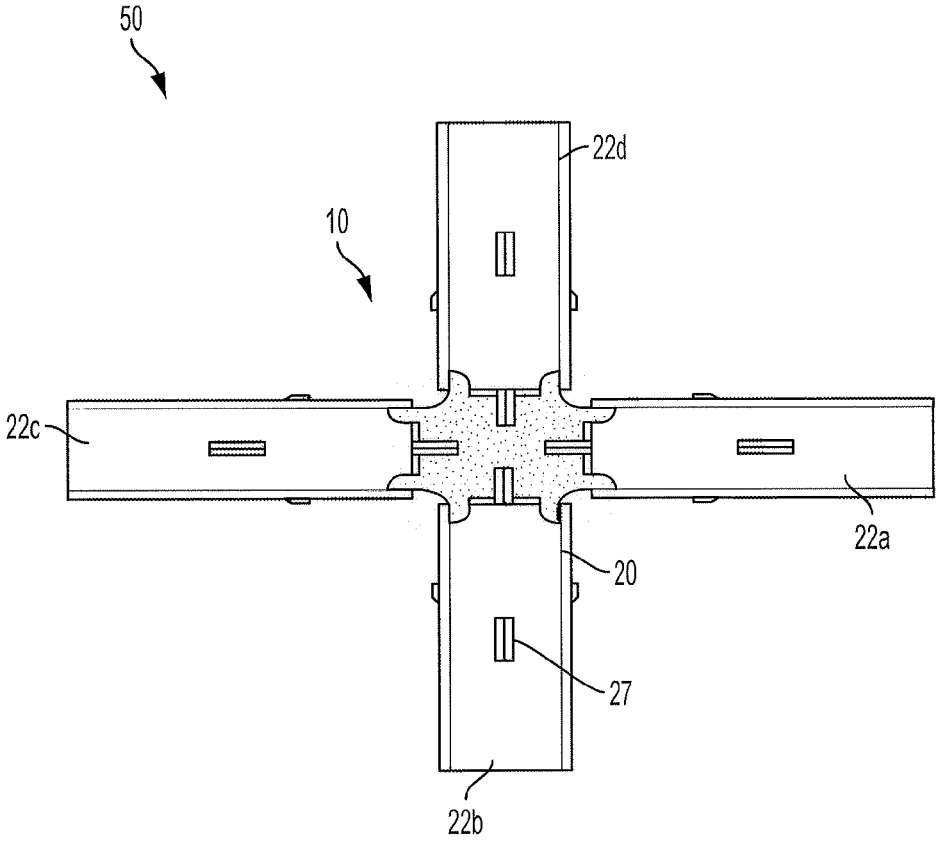
FIG. 6 is a top view of a full assembly of an RF radiating element including four radiating arms attached to two crossed PCBs via the retaining clip, according to an aspect of the present disclosure.
Figure 7:
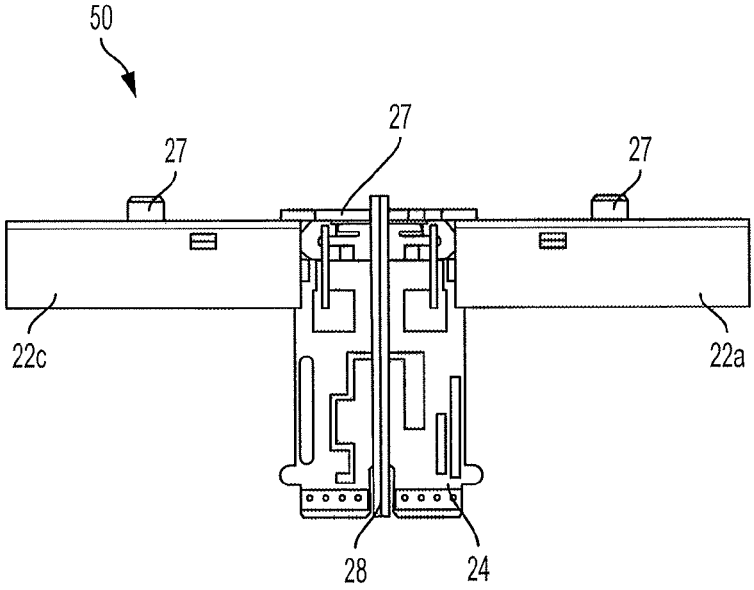
FIG. 7 is a side view of a full assembly of an RF radiating element including four radiating arms attached to two crossed PCBs via the retaining clip, according to an aspect of the present disclosure.

Other radiating arms may be attached in a similar fashion as described above. For example, another radiating arm 22*b* may be connected to the opposite end of the PCB 24 to which the radiating arm 22*a* is attached. Further, radiating arms 22*c*, 22*d* may be attached to opposing ends of another PCB 28. Such additional attachments may result in a full assembly of an RF radiating element 50 as shown in FIGS. 5-7. As best seen in FIG. 5, a perspective view of the full assembly, of the RF radiating element 50, a portion of each of the first and second PCBs 24, 28 may be connected to a ground plane on a feedboard 52, which may include a feed network. Notches and/or other cut outs may be included in each PCB 24, 28 to facilitate sliding the PCBs 24, 28 together, which may create a cross-polarized radiating element (or referred to herein as simply an RF radiating element). The PCBs 24, 28 may be fit together such that the PCBs 24, 28 are at approximately right angles to each other. However, it should be noted that the PCBs 24, 28 may be connected such that angles of other degrees may be formed as well. Accordingly, the retaining assemblies 14 may be positioned to secure PCBs 24, 28 at such other angles as well. Further, the retaining clip 10 may be configured to include fewer or more than four retaining assemblies 14 to be employed with other types of base station antenna element configurations.

Figure 8:
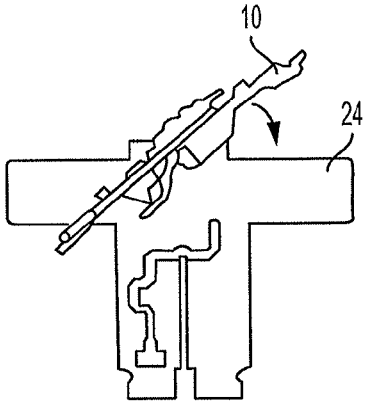
FIG. 8 is an illustration of the retaining clip connected to a first PCB; according to an aspect of the present disclosure.

FIGS. 8-12 illustrate a method for connecting radiating arms 22*a-d* to the each of the PCBs 24, 28 according to an aspect of the present disclosure. As shown in FIG. 8, the retaining clip 10 may be connected to a first PCB 24 by sliding one of the retaining assemblies 14 underneath the capture 27 of the first PCB 24; and then pivoting the retaining assembly 14 at an opposing end of the retaining clip 10. The opposing retaining assembly 14 may then be slid underneath another capture of the first PCB 24.

Figure 9:
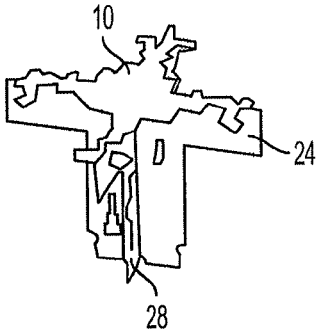
FIG. 9 is an illustration of a second PCB being crossed with the first PCB to prevent lateral movement of the retaining clip, according to an aspect of the present disclosure.
Figure 12:
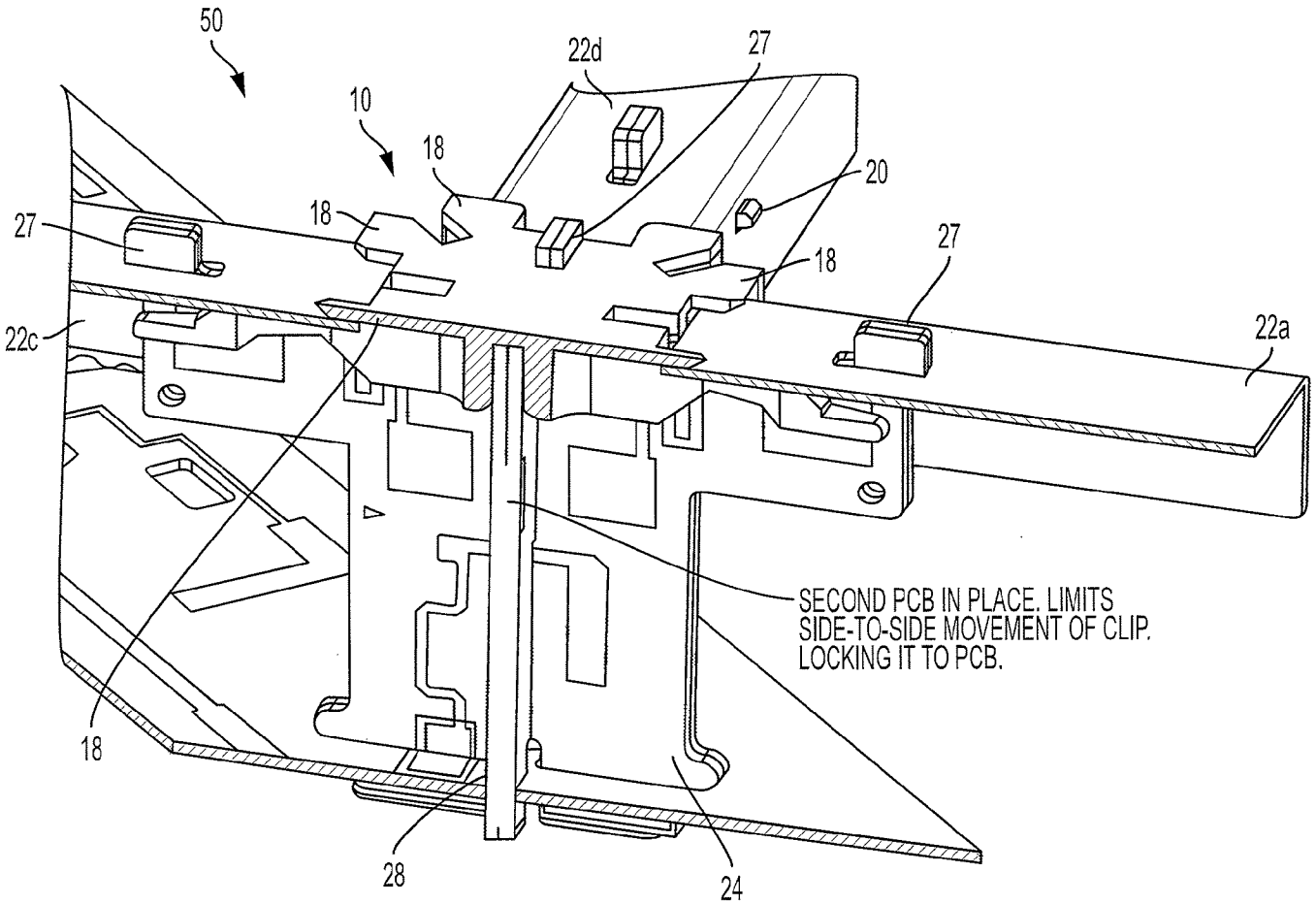
FIG. 12 is a cross-sectional view of the second PCB being crossed with the first PCB to prevent lateral movement of the retaining clip, according to an aspect of the present disclosure.

As shown in FIG. 9, a second PCB 28 may be engaged to the first PCB 24 through a slot of the first PCB 24. As best seen in FIG. 12, such an engagement of the second PCB 28 to the first PCB 24 may also serve to prevent lateral movement of the retaining clip 10, by, for example, slidably engaging either of the PCBs 24, 28 in one or more cavities of the retaining clip 10.

Figure 10:
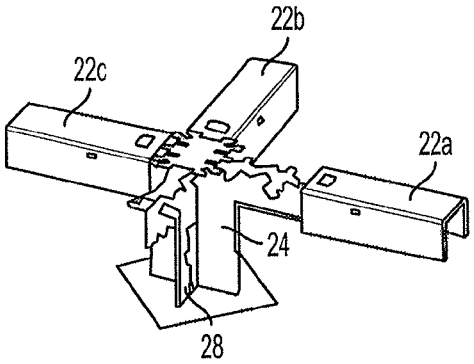
FIG. 10 is an illustration showing radiating arms coupled to the first and second PCBs using the retaining clip, according to an aspect of the present disclosure.
Figure 11:
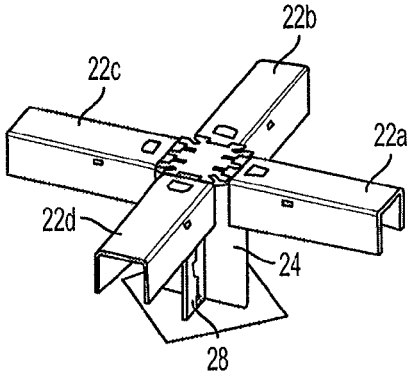
FIG. 11 is a perspective view of a full assembly of an RF radiating element including four radiating arms attached to two crossed PCBs via the retaining clip, according to an aspect of the present disclosure.

Referring now to FIG. 10, each of the radiating arms 22 may be slid onto each of the retaining assemblies 14, and locked into place, at least in part by the outward force of the tabs retaining the arms to the retaining clip 10 and the first and second PCBs 24, 28. Upon connection of all radiating arms 22*a-d*, a full assembly may be realized, as shown in FIG. 11.

The above method described in succession in connection with FIGS. 8-12. However, it should be noted that the above method may be performed in any order in still keeping with the invention.

Various aspects of the disclosure have now been discussed in detail; however, the disclosure should not be understood as being limited to these aspects. It should also be appreciated that various modifications, adaptations, and alternative aspects thereof may be made within the scope and spirit of the present disclosure.

What is claimed is:

1. A clip for securing a radiating arm to an antenna member, the clip comprising:

a central body; and a retaining assembly extending radially from the central body, wherein the retaining assembly includes a deflectable finger that is configured to extend into an interior of the radiating arm, the radiating arm being configured to radiate a signal from a feed network associated with the antenna member, wherein a tab of the deflectable finger is configured to extend through a hole in the radiating arm to an exterior of the radiating arm.

2. The clip of claim 1, wherein the clip is made from a resilient plastic.

3. The clip of claim 1, further comprising first and second arm supports coupled to the central body, wherein a portion of the radiating arm is configured to rest between the first and second arm supports, the first and second arm supports being configured to prevent lateral movement of the radiating arm attached to the clip.

4. The clip of claim 1, wherein the antenna member is part of a crossed dipole element.

5. The clip of claim 1, wherein the radiating arm includes an upper wall and first and second opposed sidewalls extending downwardly from the upper wall, and wherein the deflectable finger extends between inner surfaces of the first and second opposed sidewalls.

6. The clip of claim 5, wherein a first part of the clip extends over the upper wall of the radiating arm and a second part of the clip extends underneath the upper wall of the radiating arm.

7. The clip of claim 1, wherein the deflectable finger is a first deflectable finger, the retaining assembly including a second deflectable finger that is configured to be biased away from the first deflectable finger.

8. The clip of claim 1, wherein the antenna member includes a printed circuit board having a capture that is received through a second hole in the radiating arm.

9. The clip of claim 1, wherein the tab is positioned at an end of the deflectable finger opposite the central body.

10. The clip of claim 1, the clip has at least eight deflectable fingers.

11. A clip for securing a radiating arm to an antenna member, the clip comprising:

a central body; and a retaining assembly extending radially from the central body, wherein the retaining assembly is configured to be connected to the radiating arm, the radiating arm being configured to radiate a signal from a feed network associated with the antenna member, wherein the retaining assembly includes first and second deflectable fingers that are configured to engage respective holes in the radiating arm, wherein the first and second deflectable fingers are configured to be biased away from each other.

12. The clip of claim 11, wherein the radiating arm includes an upper wall and first and second opposed sidewalls extending downwardly from the upper wall, and wherein the first and second deflectable fingers extend between inner surfaces of the first and second opposed sidewalls.

13. The clip of claim 11, wherein the antenna member includes a printed circuit board having a capture that is received through a second hole in the radiating arm.

14. The clip of claim 13 wherein the second hole is in a top surface of the radiating arm.

15. The clip of claim 11, further comprising first and second arm supports coupled to the central body, wherein a portion of the radiating arm is configured to rest between the first and second arm supports, the first and second arm supports being configured to prevent lateral movement of the radiating arm attached to the clip.

16. A clip for securing at least one radiating arm to at least one antenna member, the clip comprising:

a central body; and one or more retaining assemblies extending radially from the central body, wherein at least one of the one or more radiating assemblies is configured to be connected to the at least one radiating arm, and wherein the at least one radiating arm is configured to receive a radio frequency (RF) signal, or radiate an RF signal from a feed network associated with the at least one antenna member, the at least one antenna member including a first printed circuit board including one or more captures, wherein at least one of the one or more retaining assemblies comprises at least one deflectable finger configured to engage side holes positioned on opposing sides of the at least one radiating arm, and wherein at least one of the one or more captures is configured to be inserted into a top hole of the at least one radiating arm, the top hole being positioned between the opposing side holes of the at least one radiating arm.

17. The clip of claim 16, further comprising at least one tab positioned at an end of the at least one deflectable finger opposite the central body, the at least one tab configured to be inserted into the at least one hole.

18. The clip of claim 16, wherein at least one of the one or more retaining assemblies includes at least first and second deflectable fingers configured to engage respective holes in the at least one radiating arm.

19. The clip of claim 16, further comprising first and second arm supports configured to prevent lateral movement of the at least one radiating arm attached to the clip.

* * * * *